US007182340B1

(12) United States Patent
Tim

(10) Patent No.: US 7,182,340 B1
(45) Date of Patent: Feb. 27, 2007

(54) HOCKEY PLAYER TOY

(75) Inventor: Dylan Lam Kang Tim, Kowloon (HK)

(73) Assignee: Sinolink Holdings (China) Ltd., Kowloon (HK)

( * ) Notice: Subject to any disclaimer, the term of this patent is extended or adjusted under 35 U.S.C. 154(b) by 0 days.

(21) Appl. No.: 11/318,139

(22) Filed: Dec. 23, 2005

(51) Int. Cl.
*A63H 3/20* (2006.01)

(52) U.S. Cl. ..... 273/108.5; 273/129 K; 273/129 L; 273/108.1; 446/333; 446/330; 446/366

(58) Field of Classification Search ..... 273/108.1, 273/108.5, 108.51, 108.55, 108.56, 129 R, 273/129 K, 129 L, 129 W, 129 V; 446/154, 446/330–336, 307, 484, 359–366
See application file for complete search history.

(56) References Cited

U.S. PATENT DOCUMENTS 1,633,456 A * 6/1927 Norberg ..... 446/333
2,799,501 A * 7/1957 Luis ..... 273/317.3
3,874,112 A * 4/1975 Sapkus et al. ..... 446/333
4,623,318 A * 11/1986 Tsiknopoulos et al. ..... 446/330
5,087,219 A * 2/1992 Price ..... 446/336
2002/0042242 A1* 4/2002 Li-Wen ..... 446/330

* cited by examiner

*Primary Examiner*—Nini F. Legesse
(74) *Attorney, Agent, or Firm*—Law Office of Sergei Orel, LLC

(57) ABSTRACT

A hockey player toy with internal motion rail for puck hitting. The major component is a hockey toy player with special internal mechanism. When the head of the toy player is pulled up, the body, which consists of front piece and back piece, will spin to pull the hockey stick back, ready for a shoot. When the head is pushed down, the body, which consists of front piece and back piece, will spin back, thus move the stick forward to hit the puck. The toy is a big break through from the previous hockey toys in its actuality. It adds a lot of fun and entertainment to the hockey toy games.

1 Claim, 5 Drawing Sheets

HOCKEY PLAYER TOY

TECHNICAL FIELD

This invention is about a hockey player toy, to be specific, a hockey player toy with internal motion rail to hit the puck.

BACKGROUND TECHNOLOGY

A hockey player toy with internal motion rail for puck hitting. The major component is a hockey toy player with special internal mechanism, which is different from similar toys currently available on market. Currently, there are two major types of hockey player model toys on market. One type has no internal motion mechanisms. The user has to spin the toy player by hand to hit the puck. The other type uses one side of the toy model as a rotation axis. When the axis is turned, the toy will spin. Since the hockey stick is placed on the other side of the toy model, the above-mentioned spinning will move the stick to hit the puck. In this type of model toys, when the toy hits the puck, it is actually the hockey player toy's stick that hits the puck. Thus it is not a real simulation of the actual hitting actions of actual players. The simulation is limited and lacks gaming fun.

DESCRIPTION OF THE INVENTION

Figure 1:
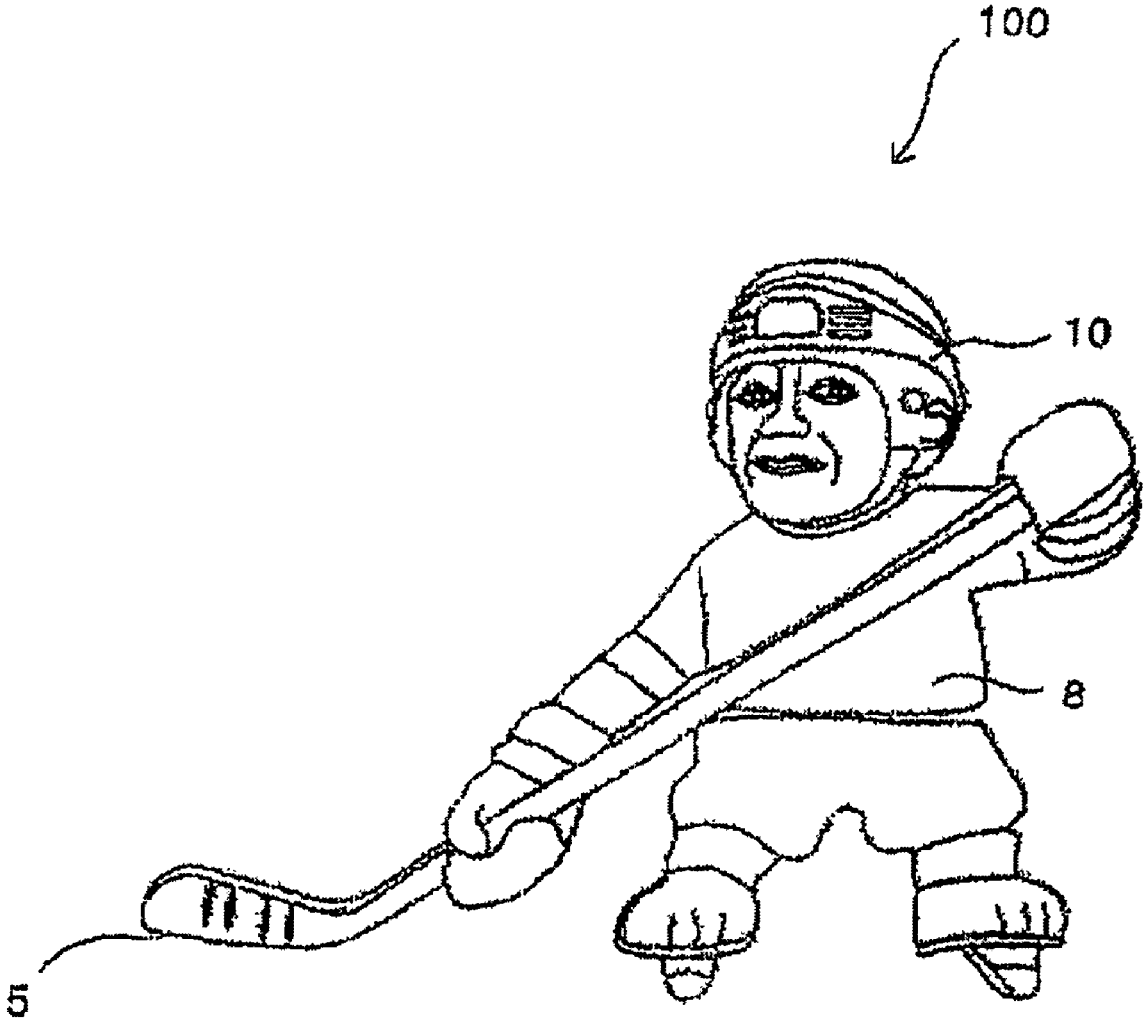
FIG. 1: The perspective of the model toy in this invention: a hockey player toy with internal motion rail for puck hitting.

Based on the issue mentioned above, the goal of this invention is to provide a hockey player toy with internal motion rail for hitting a puck. There is a motion rail hidden inside the toy player's body. Thus the model player's body can be turned to use the stick to hit the puck. This greatly increases the resemblance to the real players, and adds more fun to the game.

To achieve this goal, this invention provides a hockey player toy with internal motion rail for puck hitting. It consists of the following:

A head piece as the head and neck of the player model toy. The head piece is placed at the top of the toy. It is extending from head to neck. There is a neck fixing block at the rear bottom of the neck. At the bottom of the head piece there is a head piece hole.

A front piece as the front half of the player model's body. This piece includes the front half of the player model's body, as well as its hands with the hockey stick. There are two front-back piece fixing poles at both sides of the bottom of the front body piece. In the center of the bottom, there is a front body bottom opening (a half circle). In the center of the top, there is a front body top opening (a half circle) as well. Inside the front body piece, there is a waist motion rail in the center. The rail extends from upper-left side all the way to the bottom-center.

A back piece as the back half of the player model's body. There are two front-back piece fixing holes at both sides of the bottom of the back piece, allowing the front-back piece fixing poles to lock in to secure the front piece with back piece. In the center of the bottom, there is a back body bottom opening (a half circle). This opening, when fixed with the front body bottom opening of the front piece, will form a hole to hold the foot piece fixing pole. In the center of the top, there is also a back body top opening (a half circle). This opening, when fixed with the front body top opening of the front piece, will form a hole to hold the head piece fixing pole. At the upper-right corner of the back piece, i.e., where the left shoulder locates, there is an opening to hold the left arm of front piece. And, A foot piece as the lower body of the player model. It includes abdomen and two legs. There are two hockey skates on the feet. Above the waist, in the center, there is a standing pole, which can be divided into three parts. These three parts, from bottom to top, are: base pole, collar flange, and pole body. The diameter of the base pole is smaller than that of the collar flange. Thus, when the base pole is held in the foot piece holding hole, which is formed by fixing the front body bottom opening and back body bottom opening, the collar flange can press on the foot piece holding hole to prevent the foot piece from dropping out of the toy. The pole body stands on top of the collar flange. It is smaller in diameter. The cross section of the pole body is a rectangle. It fits right on the bottom hole of the head piece. Thus the head piece can only move up and down, and can not rotate around.

This invention uses simple internal rail structure so that the model player toy, when assembled together, can rotate the waist and hit the puck. The movements are simulations of real hockey players' puck hitting movements. It is a big break through in the similarity to the real world, and adds more fun to the model toy.

Step-by-Step Operations

Referring to FIG. 1, the fiure shows the perspective of the model 100 in this invention: a hockey player toy with internal motion rail for puck hitting. Use your hand to hold the head 10, which belongs to head piece 1 of mode 100. Pull up and then press down to control the body 8; which is formed by front piece 2 and back piece 3, to spin the hockey stick 5 to hit the puck.

Figure 2:
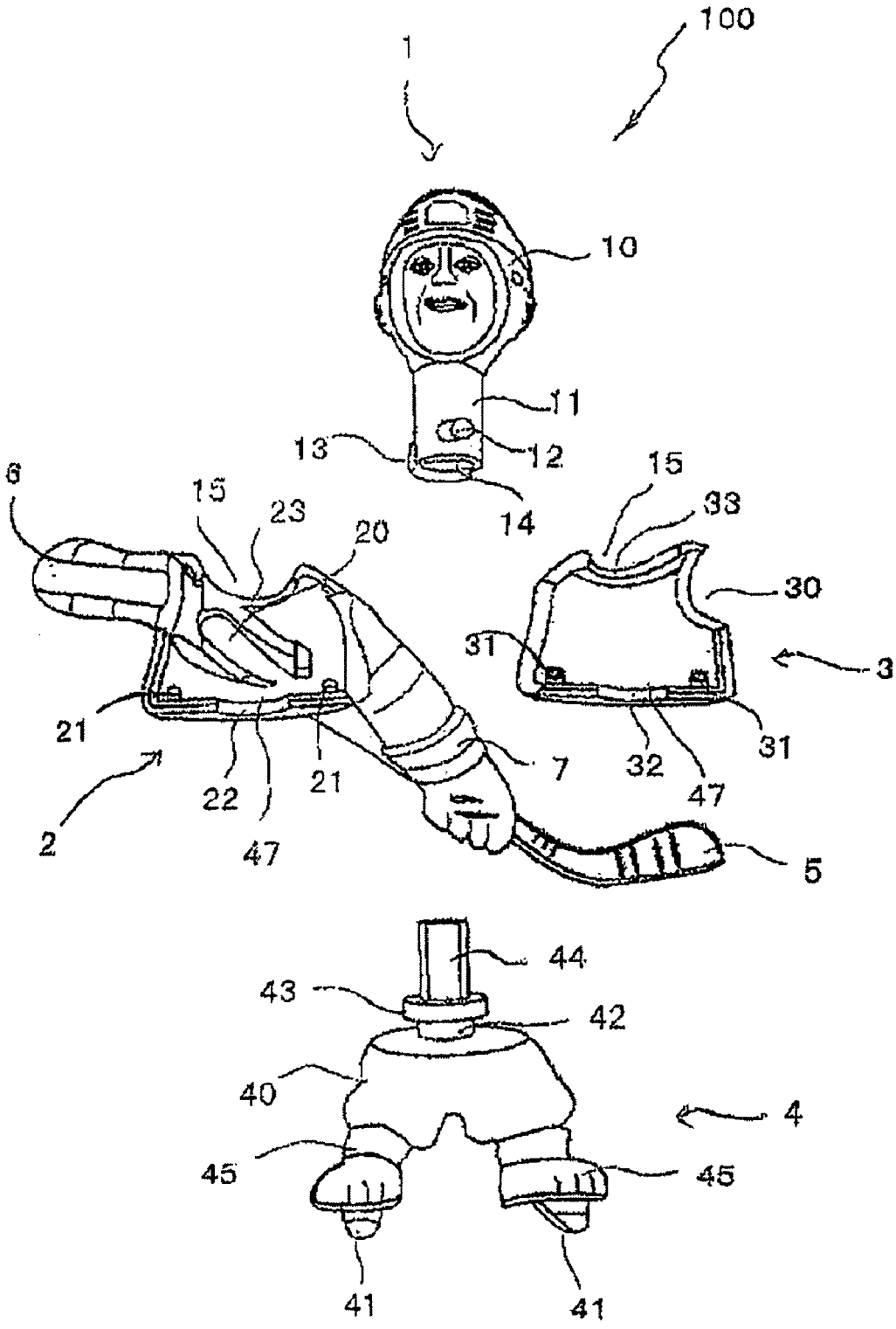
FIG. 2: The dissembled model toy that is shown in FIG. 1.
Figure 3:
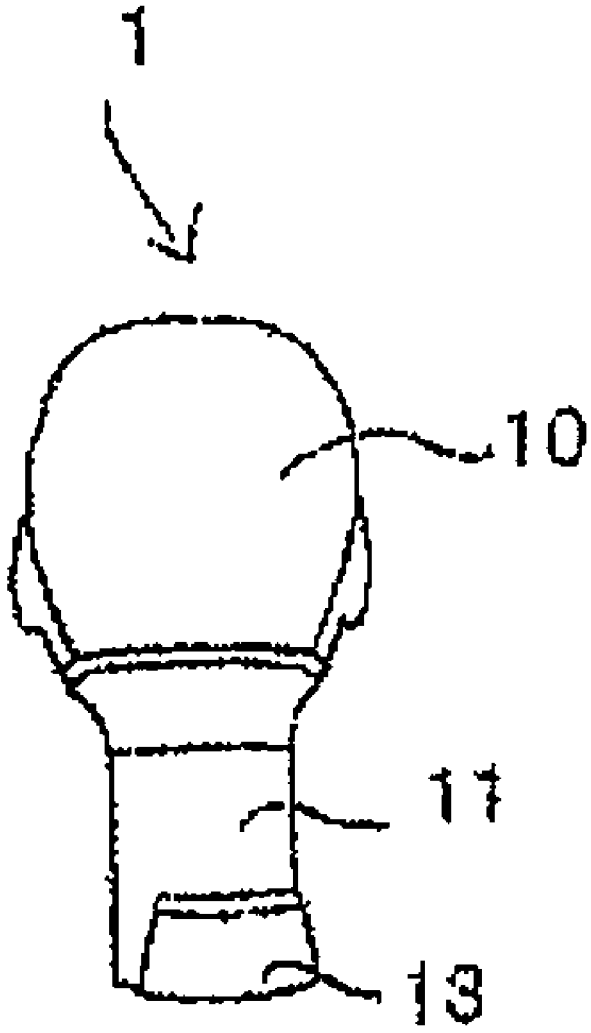
FIG. 3: The rear view of the head piece that is shown in FIG. 2.

The dissembled model 100 is shown in the FIGS. 2 and 3. It includes: a head piece 1 of model 100, which forms its head 10 and neck 11, a front piece 2, which forms the front part of body 8 of model 100, a back piece 3, which forms the rear part of body 8 of model 100, and a foot piece 4, which forms the lower half of model 100. Head piece 1 is located on the top of model 100, extending from head 10 to neck 11. The bottom of neck 11 resides inside front piece 2 and back piece 3. The size of neck 11 is the same as the head piece hold hole 15, which is formed by fixing front piece top opening 23 and back piece top opening 33. The neck fixing block 13 extends back from the bottom of neck 11, forbidding head piece 1 from body 8 of model 100, while allowing neck 11 to move up and down in the head piece holding hole 15. The head piece bottom hole 14 of head piece 1's section is identical to the foot piece standing pole 44. Both are rectangles to connect head piece 1 and foot piece 4. Thus head piece 1 can move vertically but can not rotate. Foot piece 4 consists of the two legs 45 and abdomen 40 of model 100. There are two hockey skates 41 beneath leg 45, so that it can stand on the ground. In the center of waist 40, there stands a pole, which can be divided into three parts. From bottom to top, these three parts are: base pole 42, collar flange 43, and standing pole 44. The diameter of base pole 42 is smaller than that of the collar flange 43. Thus, when base pole 42 is held in the foot piece holding hole 47, which is formed by fixing the front body bottom opening 22 and back body bottom opening 32, the collar flange 43 can press on the foot piece holding hole 47 to prevent the foot piece 4 from dropping out of the toy model 100. Then, one can place the rail motion peak 12 locating on the bottom from of neck 11 to the waist motion rail 20 of front piece 2 precisely. Then one can place the front-back locking hole 31 on back piece 3 into front-back locking pole 21 precisely, so that body 8 of model 100 is formed between head piece 1 and foot piece 4. The assembling process is done. Since this model 100 uses left hand 6 to support right hand 7 to hold stick 5 to hit the puck, left hand 6 extends backward. Thus upper-right corner of back piece 3 sinks to form a left should opening 30, to make sure that left arm 6 of front piece 2 extends backward.

Figure 4:
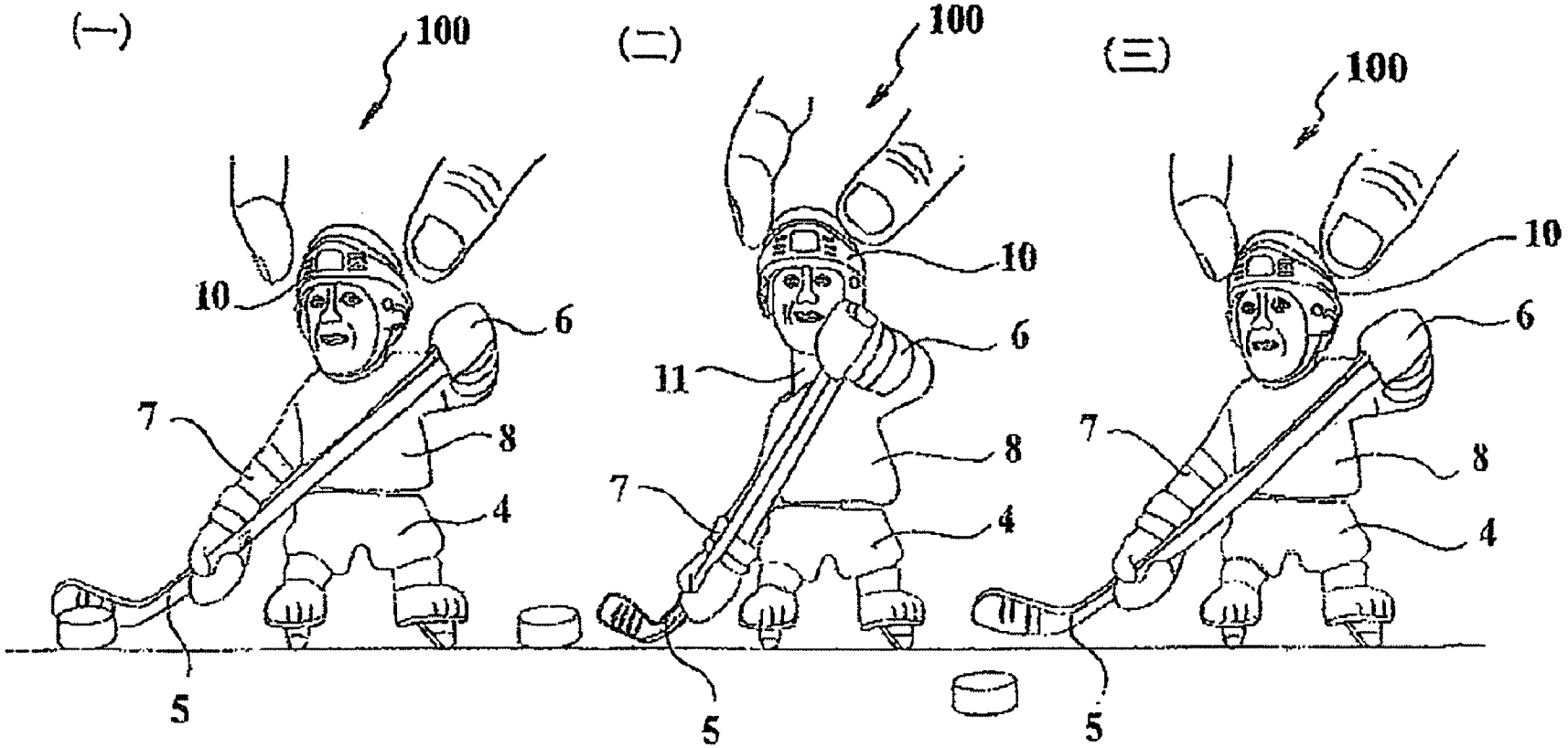
FIG. 4: The play instruction of the model toy that is shown in FIG. 1.
Figure 5:
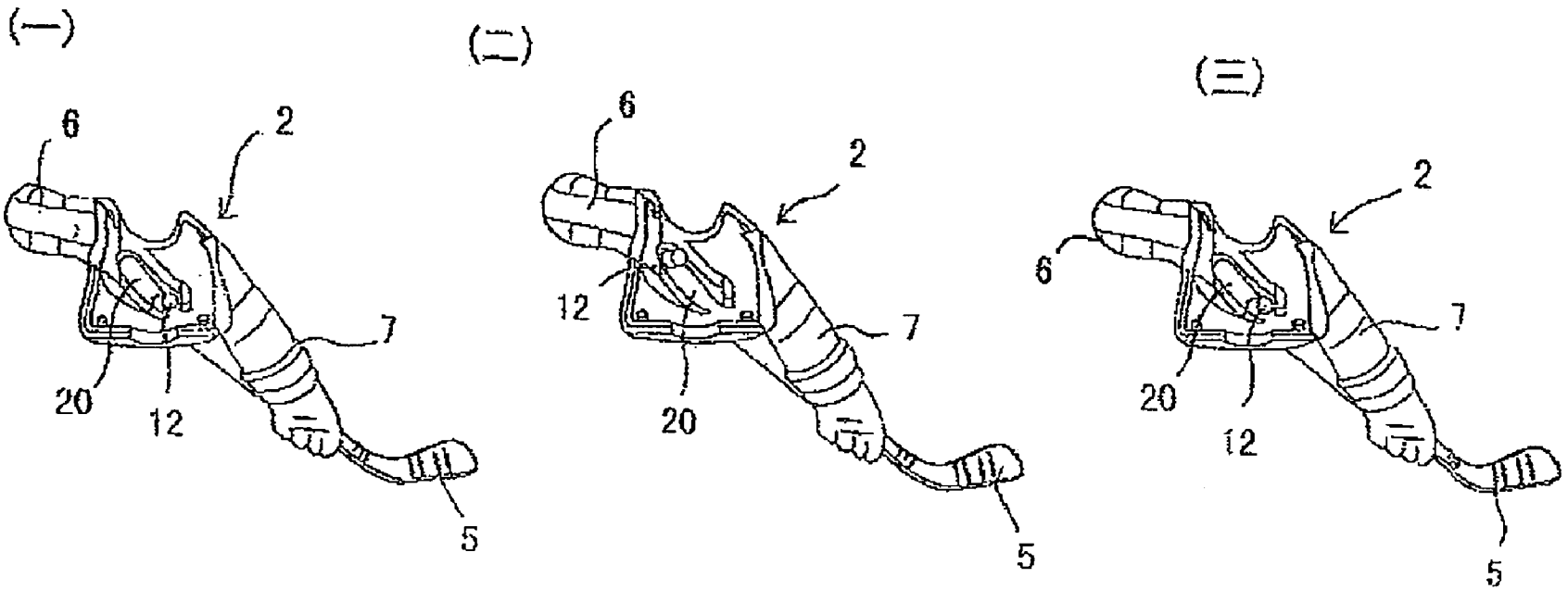
FIG. 5: The step-by-step analysis of the model toy's rail motion and waist rotation that is shown in FIG. 4.

Finally, FIG. 4 and FIG. 5 give the illustration of model 100's motion and step-by-step explanation of rail motion peak 12 and waist motion rail 20. In Step 1, the distance between head 10 and body 8 is minimal. Thus, neck 11 is completely hidden inside front piece 2 and back piece 3. Rail motion peak 12 locates at the bottom of waist motion rail 20, i.e., the center bottom of body 8. In Step 2, head 10 of model 100 is pulled up by hand. Because of body 8 and foot piece 4's weight, the distance between head 10 and body 8 gets larger. Thus some of neck 11 is pulled out. At the same time, rail motion peak 12 is dragged up along waist motion rail 20. Since the upper part of waist motion rail 20 is to the upper-left corner of front piece 2, and head 10 of model 100 can only move vertically, not rotation, body 8 of model 100 will spin clockwise, ready to hit the puck. Finally, in Step 3, push head 10 of model 100 back. The distance between head 10 and body 8 is minimal again. Rail motion peak 12 is pushed back together following waist motion rail 20. Body 8 of model 100 is then spin back counter-clockwise, thus hitting the puck. The speed and direction of the hit depends on the height that head 10 of model 100 is pulled up by hand, as well as the position and speed when head 10 is pushed back.

The model 100 that is illustrated above uses left hand 6 to support right hand 7 to hold stick 5 to hit the puck. The other implementation is to use right hand 7 to support left hand 6 to hold stick 5 to hit the puck. To allow this invention to be applied to both left-hand hockey players as well as right-hand players, just make a mirror model of front piece 2 of model 100, i.e., switch left hand 6 and right hand 7, as well as change waist motion rail from upper-left to center bottom to from upper-right to center bottom. The assembling process and operation remains unchanged. Thus makes model 100 looks more real.

From the illustration above we can see that, based on the new design of this invention, by using some simple internal mechanisms, body 8 of model 100 can spin to hit the puck. This is a breakthrough in the simulation, and adds much fun to the hockey model 100 game.

What is claimed is:

1. A model toy hockey player with internal motion rail to hit the puck, comprising:

a head piece which forms the toy's head and neck, said head piece located at the top of the model toy, extending from head to neck, a front piece which forms the front half of the model toy's body, said front piece including the front half of body and the two hands holding a hockey stick, a back piece which forms the back half of the model toy's body, a foot piece which forms the lower portion of the model toy, said foot piece includes both legs and abdomen and a waist, on top of the center of waist there is a pole, an extended rail motion peak is located on the front bottom of the head piece, a neck fixing block is located on the back bottom of the head piece, and a rectangular head piece fixing hole is located on the bottom of the head piece, two front-back locking poles located on the two sides of the bottom of the front piece, in the center of the bottom there is a front body bottom opening which is a half circle, in the center of the top of the front body piece, there is a front body top opening which is a half circle, inside the front body piece there is a waist motion rail in the center, said rail extending from upper-left side all the way to the bottom-center, said rail motion peak is placed in the waist motion rail, two front-back piece fixing holes are located at both sides of the bottom of the back piece, in the center of the bottom there is a back body bottom opening which is a half circle, in the center of the top there is also a back body top opening which is a half circle, at the upper-right corner of the back piece where the left shoulder locates there is an opening to hold the left arm of the front piece, the two front-back piece fixing holes of the back piece match the front-back piece fixing poles in the front piece, the back body bottom opening of its back piece, when combined with the front body bottom opening of the front piece, forms a hole to hold the foot piece fixing pole, the back body top opening of the back piece, when fixed with the front body top opening of the front piece, will form a hole to hold the head piece fixing pole, said head piece fixing pole is identical with the size of the neck, a standing pole of the foot piece divided into three parts, from bottom to top, base pole, collar flange, and pole body, the diameter of the base pole is smaller than that of the collar flange, wherein when the base pole is held in the foot piece holding hole, the collar flange can press on the foot piece holding hole, the pole body stands on top of the collar flange and extends upward, the cross section of the pole is rectangular on both top and bottom and the shape is identical to the bottom of the head piece fixing hole.

* * * * *